United States Patent [19]

Ireton

[11] Patent Number: 4,611,539

[45] Date of Patent: Sep. 16, 1986

[54] DEVICE AND METHOD FOR THE PRECISION MOUNTING OF FLEXIBLE PRINTING PLATES

[76] Inventor: Carl Ireton, 3189 Sunny Crest La., Kettering, Ohio 45419

[21] Appl. No.: 781,455

[22] Filed: Sep. 30, 1985

[51] Int. Cl.[4] ..... B41C 1/02

[52] U.S. Cl. ..... 101/401.1; 101/415.1; 101/DIG. 12

[58] Field of Search ..... 101/401.1, 415.1, 382 R–383, 101/378, 426, 384, DIG. 12

[56] References Cited

U.S. PATENT DOCUMENTS

| | | | |
|---|---|---|---|
| 2,330,002 | 9/1943 | Moss et al. | 101/401.1 X |
| 2,609,749 | 9/1952 | Kreglewski | 101/382 X |
| 3,103,168 | 6/1963 | Braznell et al. | 101/401.1 |
| 3,160,096 | 12/1964 | Norton | 101/401.1 |
| 3,966,396 | 6/1976 | Howes et al. | 101/401.1 |
| 4,380,956 | 4/1983 | Elworthy | 101/383 X |
| 4,467,722 | 8/1984 | Klingelhoefer | 101/383 X |

FOREIGN PATENT DOCUMENTS

| | | | |
|---|---|---|---|
| 2109306 | 6/1983 | United Kingdom | 101/401.1 |

*Primary Examiner*—E. H. Eickholt
*Attorney, Agent, or Firm*—Allan Redrow

[57] ABSTRACT

A method is shown for photoengraving locator apertures on a single plate or a series of flexible printing plates that form a set of color printing plates simultaneously with the production of the raised printing surfaces on the faces of the plate or series of plates. These locator apertures are used on a novel apparatus to support the plates on a common locator roll. The locator roll with an etched plate draped over it, is held by the apparatus to be precisely aligned with a plate roll or printing roller having a sticky back surface thereon. The apparatus for holding the locator and plate rollers, cooperates with the respective rollers to assure the precise alignment of the printing plate with its plate roll during the plate mounting process.

18 Claims, 6 Drawing Figures

2
2
10
12
14
30
32
34
36
38
40
41
42
44
48
50
52
76
78
80

DEVICE AND METHOD FOR THE PRECISION MOUNTING OF FLEXIBLE PRINTING PLATES

This invention relates to a device useful in the printing arts and includes a method of preparing flexographic letterpress and letterset printing plates and a device for use in the mounting of such printing plates on their plate or printing cylinders.

BACKGROUND OF THE INVENTION

Flexography was the name originally adopted for use in the packaging industry as applied to direct rotary printing using a raised image on a flexible printing plate adhered to a plate cylinder or printing roller. Additionally flexible plates have been adapted to letterpress and letterset printing where the plates can be suitably inked for carrying a fluid or paste ink to virtually any substrate. Rubber plates were used in the beginning and more recently along with rubber plates other flexible elastomeric materials have been made available for use in photopolymer plate or flexographic systems.

Currently certain flexible printing plates are made from various synthetic polymers that can be made light reactive so that a surface properly exposed can be etched to remove the non-printing areas in order to produce a plate having a cured or somewhat hardened raised printing surface. The flexible photopolymer surface is preferably backed with a dimensionally stabilizing polyester support or other sheet material that serves to reduce register distortions that might result from the processing, mounting, or usage of the plate.

Flexible rubber plates are made from a photographic negative by making a surface on a zinc plate light sensitive and then etching the zinc plate after exposure through the negative. The zinc plate is then impressed in a mold while heat and pressure is applied and the mold is used to produce a flexible rubber printing plate.

Such flexible plates produced from photographic negatives are currently used for black and white as well as color printing on paper, plastic film, metal foil, but they can also be used on most any other surface that can be run through a printing press. One of the requirements for high quality multi-color printing is that all of the printing surfaces on the respective color printing plates be properly positioned on their respective plate rollers so that when the web being printed upon is fed into contact with printing plates mounted on the successive plate rollers in the press, the several colors will be applied properly to the web or substrate to be precisely positioned in their respective zones relative to the other colored zones both horizontally and vertically. This is essential in order that the colors will be placed on the web in the desired exact position to form the composite images which together reproduce the original photograph being duplicated. This exact alignment of the plates that is necessary for printing of the several colors on the web is referred to as registration and also, to some extent, precise registration is a requirement in black and white printing in certain instances where it is necessary to coordinate the printed matter with structural features on the web, for example.

Various mechanical and optical methods have been developed to obtain the desired registration of the plates for printing on their webs. To one degree or another these prior art systems have not always been too satisfactory either because of the labor involved, the expense, and accuracy of the mounting of the flexible plates on their respective plate rolls. The present invention provides a combination of known technology used in a novel combination to overcome the deficiencies of the prior art and provides an improved and inexpensive, easy to use, procedure for precisely mounting flexible flexographic letterpress or letterset printing plates on their plate rollers. More particularly this invention provides a method of preparing the flexible printing plate itself, together with provision of a very simple device adapted to be used with the plate to ensure a precision mounting of a given plate or a series of color printing plates on their respective plate rollers, which device minimizes the degree of skill needed to produce proper registration of the printing plates.

PRIOR ART

U.S. Pat. Nos.: 3,160,096 to Norton, Dec. 8, 1984; 3,406,629 to Hoexter, Oct. 22, 1968; 4,380,956 to Elworthy, Apr. 26, 1983; 4,467,722 to Klingelhoefer et al Aug. 28, 1984.

Flexography—Principles and Practices—Published by Flexographic Technical Association—Library of Congress Catalog Card No. 80-69506, see Chapter VI, Engraving and Printing Plates, pages 149–183.

These prior art disclosures show various methods of mounting photopolymer and rubber plates on their plate or printing rollers and describe the use of locator means including holes in the plate that are adapted to be punched in or formed in bars mounted at one end of a flexible plate to be fitted over locator pins to guide the plate into its desired precise mounting on the plate roller. Usually the plate is held in a fixed position on the plate roller with a double adhesive tape initially applied, preferably to the surface of the roller, which adhesively holds the plate on the roller when the roller and plate are engaged together. In some of the disclosures as mentioned above seperable locator bars using locator holes therein that cooperate between the pins of the mounting means provided for attaching the plate to the plate roller are shown.

In other disclosures the locator pins are shown mounted on the plate roller in a manner to be removed after the entire length of the plate and plate roller have been brought together. In all of these disclosures, the mounting holes used for completing the assembling of the plate on the roller are carried either on means separable from but temporarily attached to the plate or in some instances the mounting holes that must be relied upon to produce the precise alignment both horizontally and vertically of the plate with respect to the plate roll, are shown as being drilled or punched through the body of the plate itself. Since these prior art showings of alignment holes associated with the plate all teach the establishment of the hole position as a separate step from the development of the printing surfaces on the respective plates, it is apparent that at least sometimes a perfect match between the printing surfaces on the plate and the subsequent mounting thereof on the plate roller cannot be assured merely through the use of the mounting holes. In actual commercial practice the desired degree of perfection required for mounting flexible color printing plates on their respective plate rollers can only be attained when the utmost care is exercised by a very experienced and highly talented journeyman printer who has rather expensive optical alignment apparatus available to produce the necessary registration of the several plates when mounted in the printing press.

BRIEF DESCRIPTION OF THE INVENTION

As distinguished from all of the known prior art, the present invention makes use of the photoengraving process used to make the printing surfaces to simultaneously produce the alignment holes in the flexible plate. The simultaneous photo exposure of the holes and the printing surfaces on the means for producing the flexible plates or set of color printing plates from the identical photonegative, which printing surfaces and the alignment holes are simultaneously produced into the plate surface, positively assures the precise position of all of the alignment holes in all of the plates in the precise spots needed for perfect alignment of the several plates on their respective plate rollers. By following this procedure any possible misalignment which might otherwise be produced by slight misalignment of a punching or drilling means is eliminated.

Although the holes can be placed in an open area within the confines of the printing zone, preferably the locator holes are positioned outside of the actual printing areas in the margins at the sides of the plates. When the holes are spaced as widely apart as possible and along a line vertical to the sides of the plate, a very precise alignment of the plate can be assured when mounting it on the pins carried by the locator roller and then transferring the plate from the locator roll to the printing roller.

The use of such an alignment procedure making use of the photo exposure step to simultaneously produce the etched printing areas along with the etched locator holes, is of particular advantage in color printing press runs. Since all of the etched alignment holes of all of the several respective color printing plates in the color printing set are each derived from the photographic negatives produced from the original art work in the usual manner for making color separation plates, it is obvious that all of the locator holes are duplicated identically in each one of the several plates and a most exact alignment of the locator holes and the successive color printing areas on all of the plates will be produced.

It will be necessary, of course, to mount the different photographically exposed color printing plates on their respective plate rollers in a proper registration in a rotated direction to be otherwise aligned in the usual manner to produce the multicolored print, but the matching of the colors to produce the composite finished print will be greatly facilitated when the exact longitudinal and horizontal mounting of each plate on its plate roller is identical to the mounting of the other plates on their respective plate rollers. It is then a much simpler procedure to merely rotate the printing or plate rollers a few degrees plus or minus to produce the required registration to cause the several printed colored areas to cooperate to duplicate the design or color picture desired.

In a further improvement it is suggested that the locator holes be positioned approximately halfway along the length of the plate. When the printing plate is supported at its mid-point on a locator device in a position to be wrapped around a printing or plate roller having a double adhesive tape applied to its surface, if any minute error of longitudinal alignment is present, this center or half way locating manner of supporting the plate during the mounting thereof, divides any possible slight misalignment error in half, as will appear more fully below.

DRAWINGS

DETAILED DESCRIPTION

In the preferred form of this invention, the flexible printing plate of this invention is produced in part in the conventional way as described in the Flexography book cited above. The photopolymer plate is first exposed to ultra violet light on its back side for a period of time to harden or cure the back side of the plate to a desired depth in order to determine the depth of the relief to be produced on the front side of the plate during the etching process. After completion of this preliminary partial hardening step, the plate is then turned over and assembled with the photographic negative to expose the front side of the plate to ultra violet light to harden some of that surface to produce the printing surface. After the proper exposure of the face of the plate to the ultra violet light through the negative to harden the printing surface, the negative is stripped from the plate and it is etched or washed to remove the unhardened polymer thus leaving the hardened printing surface, supported on the hardened back portion, the printing surface being exposed in relief. After washing, the plate is dried and the entire face of the plate is again exposed to the ultra violet lights to fully hardened its entire face and it is then trimmed and prepared for mounting on its plate roller.

Figure 3:
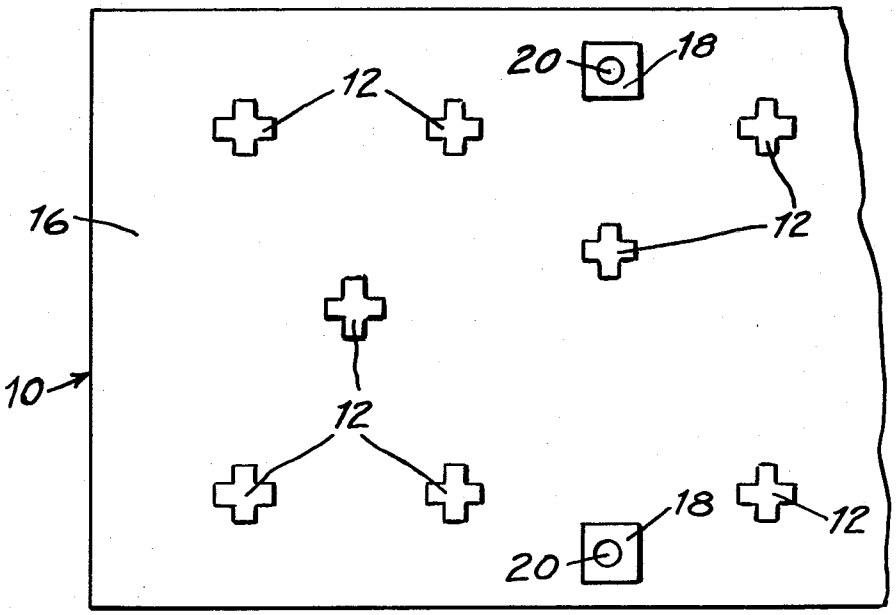
FIG. 3 is a plan view showing a plate made in accordance with my invention.

As shown in FIG. 3 a flexible rubber plate can be made as above described or a photopolymer plate 10 can be exposed and developed as just described to have printing surfaces on its front side represented by the crosses 12. The exposed surfaces of all of these crosses will be inked when the plate is mounted on a printing roller that is running in a printing press, to produce the desired printed message.

Figure 4:
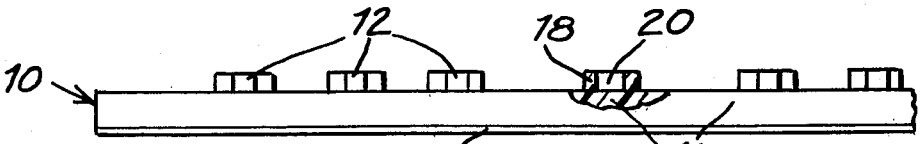
FIG. 4 is a side elevation partly broken away showing the plate of FIG. 3.

As shown in FIG. 4, the preferred form of plate is a photopolymer and this plate 10 is composed of a backing, usually a thin layer of mylar or aluminum 14; the light hardened non-etched layer 16; and the upstanding printing characters 12, the exposed surfaces of which form the printing surface of the plate.

In accordance with this invention, during the photographic exposure step and development of plate 10 to produce the printing characters 12, locator holes 20 are being simultaneously photographically reproduced, the holes being surrounded by the hardened unetched plate material 18. The exposed surfaces of the material 18 that surrounds each hole 20, are co-planar with the printing surfaces of crosses 12 and the holes 20 are washed out during the etching or washing step to be as deep as the washed out depth of the walls of the printing surfaces. Also, it is to be noted that the surfaces of material 18 are positioned where surfaces 18 will not interfere with the printing and are preferably outside of the exposed areas 12 forming the printing surfaces. As described above, these locator holes when formed in a set of color printing plates, are exactly coordinated by means of the printing process that is carried through from the original art work so that all of the locator holes are photographic reproduced in identical positions for each one of the respective plates forming the set of color printing plates, to coordinate with the positions of the printing surfaces resulting from the photo exposure process. Thus, when all of the respective color plates of a color set are reproduced in this manner photographically, all of the locator holes in all of the plates are etched in the identically same spot on each plate of the series.

Once the flexible printing plate has been prepared as above described, it is ready to be mounted on its printing or plate roller. To accomplish this, referring to FIG. 1, the plate is adapted to be first temporarily supported on a locator roll 30. The locator roll is supported in a suitable rack means 32 with the flexible plate draped over it with its printing face on the roller 30 and in a position so that the plate or printing roller 34 can be brought into contact with the back 14 of the plate 10. The locator roll is carried in the rack that has sidewalls 46 and 47 that are provided with V-bearings, the left hand wall 46 having a planar inner wall surface against which the end of the locator roll bears for aligning it with the plate or printing roll as will appear more fully below. By making suitable manipulations, the plate can be attached to the printing roller.

The locator roller 30 is provided with a dovetail slot 36 that is precisely cut lengthwise along one area of its periphery to be exactly parallel with the axis about which the locator roll rotates. The dovetail slot is adapted to cooperate with correspondingly shaped slider means 38, best seen in FIG. 2, that support locator pins 40 which protrude vertically beyond the periphery of the locator roll a distance equal to or less than the depth of the holes 20 and have a configuration to neatly fit that of the holes 20. There are two such slider means mounted in the dovetail slot and when each slider is positioned precisely where desired, it is locked in place in the slot 36 by any suitable arrangement such as by means of a set screw 41 carried by the locator pins that press against the floor of the slot.

Figures 1, 2, 6:
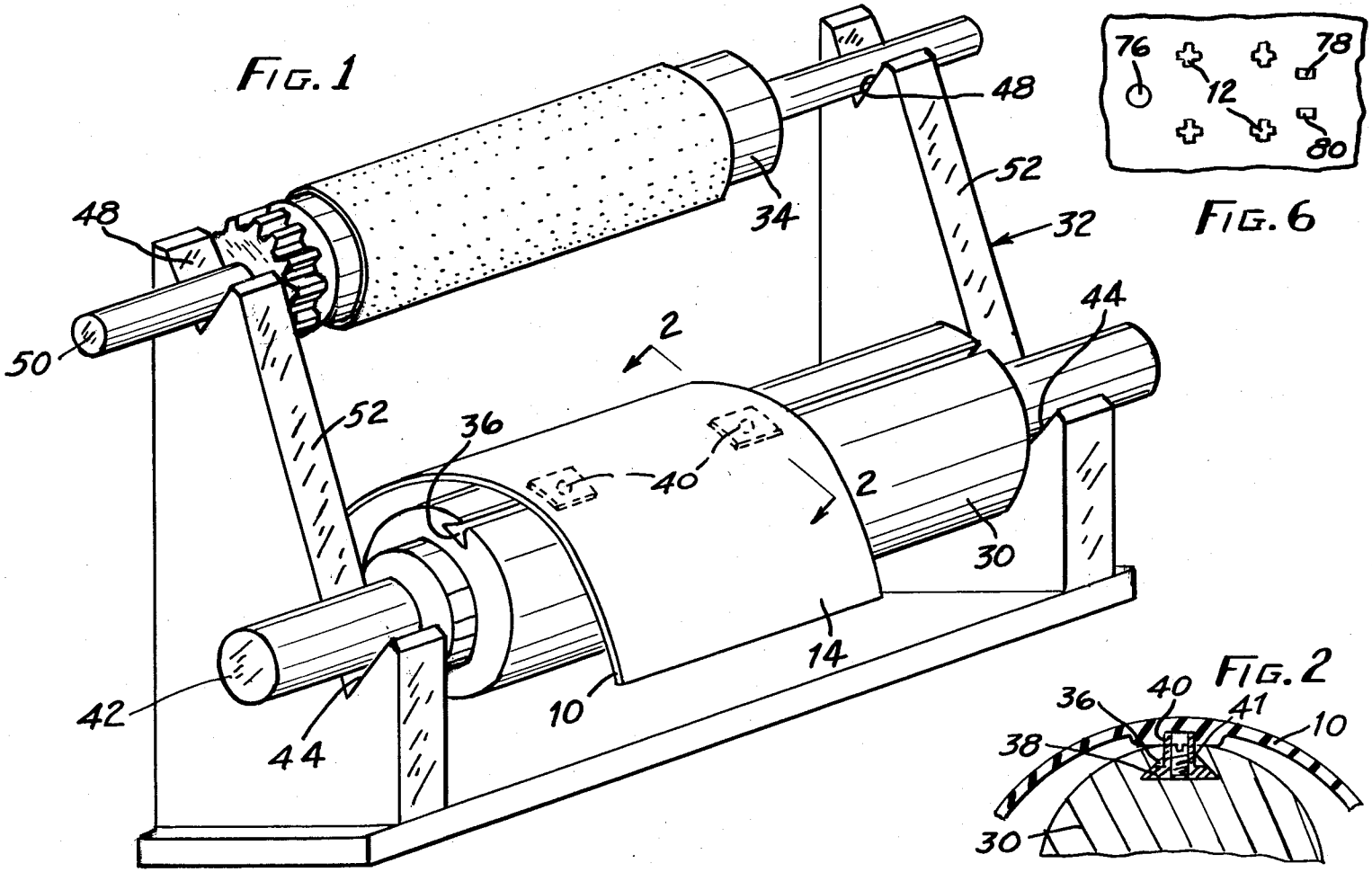
FIG. 1 is a perspective view of a device for completing the mounting of a flexible printing plate on its plate roller in accordance with this invention.
FIG. 2 is a broken away sectional view taken on line 2—2 of FIG. 1.
FIG. 6 is a sectional plan view of an alternate form of the printing plate structure.

Once the pins 40 have been fixed in position on the locator roll, the flexible plate may be draped over the roll as best shown in FIGS. 1 and 2. The holes 20 at the opposite sides of the plate are fitted snugly onto the exposed ends of the spaced apart locator pins 40 fixed to the roller so that an exact relationship is established with respect to the printing surface of that plate and its position around the periphery of the locator roll. It will be noted that the plate is mounted on the locator roll with the raised printing surfaces of the face of the plate in contact with the periphery of the locator roll.

The locator roll is provided with an axle 42 that has cylindrical bearing surfaces that are concentric with the axis of the locator roll and the axle is supported at its opposite ends in precision aligned V-bearings 44 formed in the opposite sidewalls 46 and 47 of the rack 32.

At their upper ends the sides 46 and 47 each have additional aligned V-bearings 48. These bearings support the axle 50 of the plate or printing roll onto which the etched plate is to be adhered and, as is conventional, for this purpose, the roll 34 is covered with two faced sticky back. The plate roll is first positioned with its axle 50 supported at each end in bearings 48 and in a position with its end against the inner planar alignment surface of wall 46 and when the plate roller is ready to be mated with the flexible plate supported on the locator roll, the axle 50 of the plate roller is eased out of bearings 48 and carefully lowered with its end in contact with the alignment surface while the ends of its mounting shaft 49 glide downwardly along the sloping guide surfaces 52 formed in sides 46 and 47, each one of which guide surfaces forms an extension respectively of one of the sides of the lower V-bearings 44 that support roll 30.

As the plate roll is carefully lowered it ultimately comes into contact with the exposed back side of the plate 10 draped over the locator roll 30. The sticky back on the plate roll preferably is guided into contact with the back of the printing plate on a line that is exactly parallel to the axis of the locator roll and at a position stretching along a line drawn between the locator pins 40.

After the original line of contact between the surface of printing or plate roll 34 coated with sticky back with the back of the printing plate, referring to FIG. 1, the portion of the plate extending over the front portion of the rack, can be wrapped around the sticky back covered plate roller 34 with all of that portion of the back of the plate in contact with the plate roller. During this wrapping step, it has been found that the Mylar backing on a photopolymer flexographic plate for example provides the necessary degree of stiffness to permit lifting of that portion of the plate so that it can be wrapped into a smooth positive contact with the sticky back surface. After that one half portion of the plate has been attached to the plate roller the rack can be turned around and the remaining portion of the plate can be applied to the plate roller.

During the mounting of the plate 10 on printing roll 34 it is to be observed that the relative position of the exposed printing surface on that roller is controlled by the precisely formed locator holes 20 in the plate that are fitted onto pins 40. This mounting procedure is of special value when several plates in a series, as is required for color printing, are mounted on their respective plate rollers in this manner, since exact matching registration is facilitated in the printing press by a simple rotation of the several printing rollers one with respect to the other and any longitudinal adjustment of the several rollers to produce perfect alignment is eliminated and also misalignment that would otherwise result from a slight variation in the placement of punched or drilled holes cannot be present. Each of the plates of the color printing set are successively fixed in exact longitudinal alignment relative to the same pins on the same locator roll by their engagement over the pins until a firm, non-shiftable contact between the respective plate and its printing roll to which it is being applied, has been accomplished and thereafter only a slight adjustment may be needed to produce a perfect horizontal alignment of these axes of the plate. After the initial plate roll contact has been made with the plate even though only part of the plate has been adhered to the plate roller by the initial line contact between the plate and its plate roller, the mounting of the plate on the printing roller proceeds without disturbing the precision mounting of each plate on its printing roller.

This structure and the mounting procedure described above provides a very simplified procedure for precisely mounting a flexible printing plate of any conventional size on its sticky back plate roller. Advantages are derived not only from the saving of skilled labor needed to accomplish this task, but where it is necessary to mount a set of color printing plates, a considerable saving in time is realized by eliminating the skilled labor that would otherwise be required to align the color plates both longitudinally and horizontally in the printing press to produce a proper registration of the plates as is sometimes required in following the prior art methods. the precise registration produced between the set of color plates when transferring them from a locator roll to their respective printing rolls as here taught, eliminates the skill and expensive optical matching equipment formerly needed to produce this result. The combination of the photographic exposure method for producing the alignment holes and the use of the simple locator apparatus here shown for mounting the flexible plate on the printing roller produces these desirable results.

For black and white printing, as above indicated, precision mounting of a plate on its locator roll may be required to position the printing surface in an exact relationship of printed matter with respect to structure of a previously applied border or other design.

While it would be possible to lay the flexible plate printing face down on a flat locator plate to hold it in fixed position relative to the printing or plate roller to which it is to be attached, the preferred method of attaching the plate to its printing roller is to drape the flexographic plate over a locator roller or a curved bearing surface. As distinguished from simply holding the plate in a planer mode, when the plate is draped over a curved surface such as the locator roll at least a portion of its hardened back section 16 is forced to assume a somewhat cylindrical shape when it is draped over a roller or other shape of curved surface, which bending of the plate tends to stiffen the body of the plate. When so stiffened, the back of the plate may be made to have a firmer contact with the sticky back coated printing roller when it is lowered into contact with the flexible plate, and a more precise and firm mounting is assured. This stiffening effect accomplished by draping the plate over a curved surface such as preferably the locator roll, has a particular utility where large areas of the face of the plate have been etched away which would leave those areas otherwise unsupported in the planar mode but which are temporarily stiffened when such an area is made to assume a cylindrical shape.

It should be noted that the left hand end of the printing roll in FIG. 1 is supported in close alignment with the inner side of wall 46 to be exactly aligned with the left end of the locator roll which is likewise aligned against the inside of the wall 46. This assures the proper follow through on the successive plates when more than one plate of a set of color printing plates, for example, are being mounted on their respective printing rollers.

It is apparent that while a manual procedure has been described above for bringing the printing roll into contact with the back side of plate draped over the locator roll, suitable linkage or other means could be used to guide the plate roll into contact with the backside of the plate. Once a precision contact between the sticky back on the printing roller and the back of the plate on the locator roll has been made, the proper alignment of the plate on the plate roll has been accomplished. Thereafter, with the exercise of reasonable care, the remainder of the process for completing the mounting of the plate on its printing roller an be easily completed, requiring only a minimum of attention for directing the plate into its seat on the roller.

Figure 5:
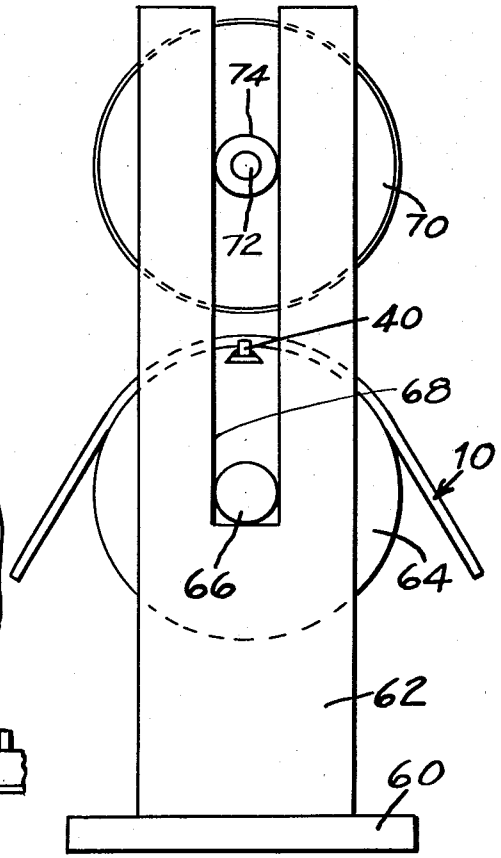
FIG. 5 is an end view of an alternate form of mounting means.

Another form of a rack means for supporting the flexible plate on a locator roll is shown in FIG. 5. This rack makes use of a base 60 for supporting two spaced apart standards 62. One standard (not shown) may be adjustably mounted on the base to be moved toward or away from the other standard to accomodate rollers of different lengths. A base roller 64 is adapted to be fitted between the standards that have been adjusted to fit its length and the base roller is rotatably supported by each end by its axle 66 that has suitable bearings in the respective standards. The base roller has a dovetail slot 36 for carrying locator pins 40 as shown with roller 30. Referring to FIG. 5, a flexible plate 10 produced from a photographic process, is adapted to be draped over the base roller 64 with its locator holes 20 fitted over locator pins 40 as described above.

The standards 62 are each provided with a vertical guide way 68 in the form of a slot to guide the plate roller 70 into contact with the backside of the plate draped on roller 64. The plate roller is of a length to just fit lengthwise between the standards to be guided into precise contact with the back of the plate on the plate roller and the extending ends of the axle 72 of the plate roll 70 may be fitted with spacer bushings 74 to assure proper line contact between the plate roller covered with sticky back paper and the back of the printing plate to be adhered thereto.

After the plate roller has been gently lowered through guide slots 68 into contact with the plate supported on roll 64, the plate can be draped over the plate roll 70 as described above for completing the attachment of the plate to roll 70.

The description above suggests that two circular locator holes be produced in the plate to cooperate with pins 40 on a locator roll. Alternatively, as shown in FIG. 6, a circular aperture 76 can be provided on one side of the plate to cooperate with a circular pin and two parallel slots 78 and 80 on the other side of the plate to fit over a pair of rectangular pins carried on another slider support 36. When a circle and slot locator pattern is used, it would be impossible to mount the plates on the printing rolls with a wrong side to the left, referring to FIG. 1. All plates developed from the same photo reproduction process, having circular holes on one side and slots on the other side, would have to be mounted on the locator roll in the same way.

Since the mounting holes or apertures 20 or 76, 78 and 80 for example are photographically positioned and then etched into the plates from the printing surface side, any shaped hole can be easily produced to fit any correspondingly shaped pin having a particular crossectional shape and any combination of different patterns can be used to assure a proper plate transfer from its locator roll to its printing roll.

It is possible that other modifications hereof will occur to those skilled in the art, which will fall within the scope of the following claims.

I claim:

1. A method of producing a flexible printing plate for mounting on a plate roller that rotates about an axis; the printing plate being adapted to be made by means of a photographic process to produce a printing surface, and having locating apertures in the printing plate, said plate being designed to cooperate with locator means having guide pins thereon, for controlling the position of the printing plate when it is temporarily carried on said locating pins, said plate being supported on said locator means for subsequent transfer of the printing plate to said plate roller comprising the steps of photographically producing the printing surfaces on the face of said printing plate, simultaneously photographically producing spaced apart locator apertures on the printing face of said plate during said photographic processing, whereby said printing areas and said locator apertures are precisely photographically positioned the one relative to the other and said locator apertures in said plate can be assembled on the locating pins of said locator means in order that the raised printing surfaces can be precisely mounted on said plate roller.

2. A flexible plate as in claim 1 wherein said locator apertures are spaced away from said printing surfaces.

3. A flexible plate as in claim 1 wherein said plate has margins on opposite sides thereof and said locator apertures are positioned in said margins.

4. A flexible plate as in claim 1 wherein said locator apertures are produced as a pair to fit onto a corresponding pair of said locator means.

5. A flexible plate as in claim 4 wherein said locating apertures have different cross sectional shapes to correspond to different cross sectional shapes on said pair of locator means.

6. A method for making and mounting a flexible printing plate on a stick-back covered plate roller wherein the printing surface of said plate is photographically produced and said plate has locator apertures adapted to be temporarily mounted on locator means during the attachment of said plate to said plate roller comprising simultaneously photographically producing a printing surface and said locator apertures onto the face of said plate, temporarily mounting said locator apertures on said locator means, and then attaching a portion of the back of said plate to said plate roller while it is mounted on said locator means to said sticky-back covered plate roller, and completing the attachment of the remainder of the plate to the plate roller and lifting the mounted plate off of said locator means.

7. A method as in claim 6 wherein said locator means includes a curved surface having locator pins intetral therewith and said plate is draped to assume a curved shape as it conforms to said surface with its face on the surface when said apertures are temporarily mounted on said locator pins.

8. A method as in claim 7 wherein said locator means is a cylinder and a portion of said plate is bent into a cylindrical shape when mounted on said locator means.

9. A method as in claim 8 wherein said locator means includes pins integral with said cylinder, said cylinder being supported in a horizontal position and said plate is draped to hang approximately evenly on both sides of said locator means.

10. A method as in claim 6 wherein said sticky-back covered plate roller is pressed against said plate that is mounted on said locator means to initiate the attachment of the plate to the printer roller.

11. A method as in claim 10 wherein said plate roller and said plate on said locator means are firmly pressed together and are oscillated in opposite directions while so pressed together to complate said attachment of the plate to the plate roller.

12. A means for mounting a flexible printing plate on a sticky back covered plate roller, said plate having a front face with locating apertures therein and a back side for engagement with said sticky back covered plate roller comprising a frame for supporting a locator means adapted to temporarily support said flexible printing plate, said locator having a bearing surface for supporting locating pins, said pins protruding from said surface along an established line, said flexible plate having said locating apertures formed therein on said front face for cooperating with said locating pins, said plate being attached to said locator means when said apertures are engaged on said pins with the front face of said plate in contact with said locator means, said frame including means for holding said plate roller with its axis aligned with said established line of said locator means and its periphery in contact with the back side of said plate attached to said locator means, said frame permitting said plate to be wrapped around said plate roller, and said frame being arranged to permit said plate roll to first contact the backside of said plate supported on said locator means in a line parallel to said established line so that said plate can be wrapped around and adhered to said stick back covered plate roller.

13. A means for mounting a flexible printing plate as in claim 12 wherein said locator means includes a base roller for rotating about said established line and said frame includes bearing means for rotatably supporting said base roller, and said frame includes cooperating guide means for delivering said plate roller into precise contact with said plate attached to said base roller.

14. A means for mounting a flexible printing plate as in claim 13 wherein said bearing means includes a V-bearing adjacent each end of said base roller.

15. A means for mounting a flexible printing plate as in claim 13 wherein said guide means are disposed adjacent the opposite ends of said plate roller and are disposed at an angle to the vertical.

16. A means for mounting a flexible printing plate as in claim 15 wherein said bearing means includes a V-bearing adjacent each end of said base roller, and said guide means are planar surfaces that lie in a plate that includes one of the legs of each of said V-bearings.

17. A means for mounting a flexible printing plate as in claim 12 wherein said locator means is a curved surface and said plate is draped over said curved surface with its back side bulging upwardly to meet said plate roller when it is brought into contact therewith.

18. A means for mounting a flexible printing plate as in claim 13 wherein said guide means take the form of spaced apart standards each of which has a vertical guideway therein.

* * * * *